US012252227B2

(12) United States Patent
Ikegaya

(10) Patent No.: US 12,252,227 B2
(45) Date of Patent: Mar. 18, 2025

(54) MARINE PROPULSION SYSTEM AND MARINE VESSEL

(71) Applicant: YAMAHA HATSUDOKI KABUSHIKI KAISHA, Iwata (JP)

(72) Inventor: Yuji Ikegaya, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 229 days.

(21) Appl. No.: 17/970,620

(22) Filed: Oct. 21, 2022

(65) Prior Publication Data

US 2023/0136043 A1 May 4, 2023

(30) Foreign Application Priority Data

Nov. 4, 2021 (JP) ..... 2021-180212

(51) Int. Cl.

| | |
|---|---|
| ***B63H 25/00*** | (2006.01) |
| ***B63H 20/12*** | (2006.01) |
| ***B63H 25/42*** | (2006.01) |
| *B63H 20/00* | (2006.01) |
| *B63H 21/20* | (2006.01) |
| *B63H 25/02* | (2006.01) |

(52) U.S. Cl.

CPC ..... *B63H 25/42* (2013.01); *B63H 20/12* (2013.01); *B63H 2020/003* (2013.01); *B63H 2021/205* (2013.01); *B63H 2025/026* (2013.01)

(58) Field of Classification Search

CPC .. B63H 25/42; B63H 20/12; B63H 2020/003; B63H 2021/205; B63H 2025/026; B63H 21/17; B63H 20/007

See application file for complete search history.

(56) References Cited

U.S. PATENT DOCUMENTS 4,573,930 A 3/1986 Queen
4,787,201 A * 11/1988 Snow ..... G05D 1/0202 60/228

(Continued)

FOREIGN PATENT DOCUMENTS

JP 2006-291927 A 10/2006
JP 2015-116847 A 6/2015
JP 2019-199148 A 11/2019

OTHER PUBLICATIONS

Official Communication issued in corresponding Canadian Patent Application No. 3180824, mailed on Apr. 22, 2024.

(Continued)

*Primary Examiner* — Anne Marie Antonucci
*Assistant Examiner* — Jordan T Smith
(74) *Attorney, Agent, or Firm* — Keating & Bennett, LLP

(57) ABSTRACT

A marine propulsion system includes a controller configured or programmed to perform a rudder angle change control to change a rudder angle of an auxiliary propulsion device by a predetermined angle to one side in a right-left direction of a hull with respect to a forward-rearward direction of the hull so as to move the hull along the forward-rearward direction without rotating the hull when motorized forward-rearward movement is performed to move the hull along the forward-rearward direction by driving the auxiliary propulsion device that is provided to one side of the hull in the right-left direction without generating a thrust from a main propulsion device.

18 Claims, 5 Drawing Sheets

(56) References Cited

U.S. PATENT DOCUMENTS

| | | | | |
|---|---|---|---|---|
| 5,362,263 | A * | 11/1994 | Petty | B63H 25/04 440/1 |
| 5,931,110 | A * | 8/1999 | Yamamoto | B63B 49/00 114/144 C |
| 2006/0234566 | A1 | 10/2006 | Ando | |
| 2007/0089654 | A1* | 4/2007 | Bradley | B63H 21/22 114/10 |
| 2010/0151750 | A1 | 6/2010 | Ito | |
| 2014/0156124 | A1 | 6/2014 | Hara et al. | |
| 2015/0072575 | A1* | 3/2015 | Mizutani | B63H 20/12 440/1 |
| 2015/0166159 | A1 | 6/2015 | Inoue et al. | |
| 2019/0179318 | A1* | 6/2019 | Miller | B63H 25/42 |
| 2020/0272152 | A1* | 8/2020 | Combs | G05D 1/0206 |
| 2021/0139123 | A1* | 5/2021 | Osara | B63H 21/14 |
| 2022/0242544 | A1* | 8/2022 | Schatz | B63H 5/08 |

OTHER PUBLICATIONS

Extended European Search Report in EP22202468.9, mailed Mar. 27, 2023, 8 pages.

* cited by examiner

FIG.7

CONTROL BY CONTROLLER OVER OPERATION ON JOYSTICK IN ENGINE DRIVE MODE AND ELECTRIC DRIVE MODE

| OPERATION ON JOYSTICK | ENGINE DRIVE MODE | ELECTRIC DRIVE MODE |
|---|---|---|
| OPERATION TO MOVE HULL IN FORWARD-REARWARD DIRECTION | DRIVE MAIN PROPULSION DEVICE | DRIVE AUXILIARY PROPULSION DEVICE |
| OPERATION TO MOVE HULL LATERALLY AND DIAGONALLY | DRIVE MAIN PROPULSION DEVICE AND AUXILIARY PROPULSION DEVICE | DRIVE MAIN PROPULSION DEVICE AND AUXILIARY PROPULSION DEVICE |
| OPERATION TO ROTATE HULL | DRIVE AUXILIARY PROPULSION DEVICE | DRIVE AUXILIARY PROPULSION DEVICE |

FIG.8

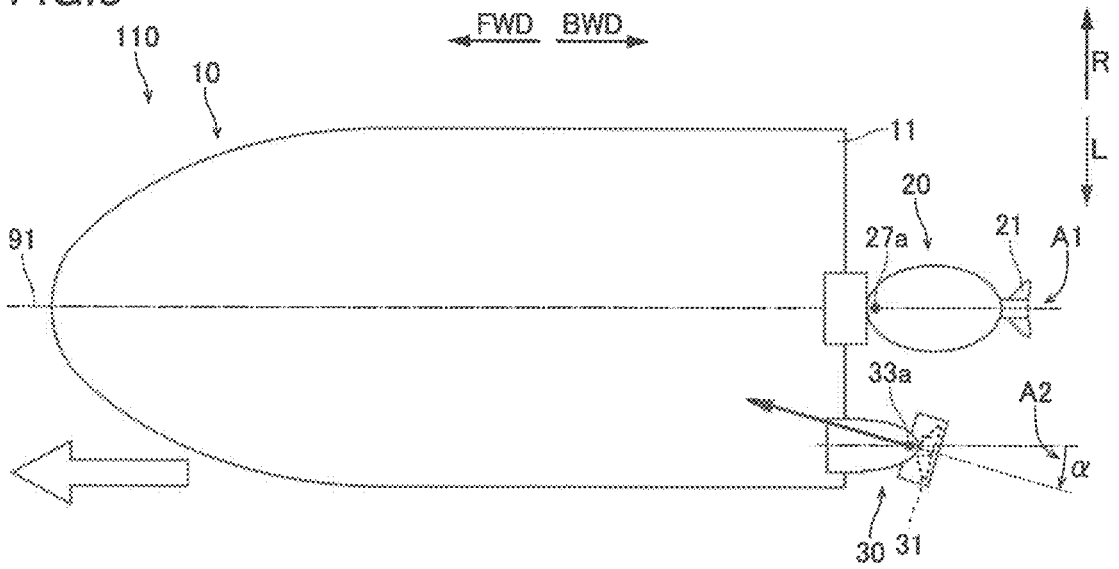

[COMPARATIVE EXAMPLE]

MARINE PROPULSION SYSTEM AND MARINE VESSEL

CROSS REFERENCE TO RELATED APPLICATIONS

This application claims the benefit of priority to Japanese Patent Application No. 2021-180212 filed on Nov. 4, 2021. The entire contents of this application are hereby incorporated herein by reference.

BACKGROUND OF THE INVENTION

1. Field of the Invention

The present invention relates to a marine propulsion system and a marine vessel, and more particularly, it relates to a marine propulsion system and a marine vessel that each perform motorized forward-rearward movement to move a hull along a forward-rearward direction by driving an auxiliary propulsion device without generating a thrust from a main propulsion device.

2. Description of the Related Art

A marine vessel that performs motorized forward-rearward movement to move a hull along a forward-rearward direction by driving an auxiliary propulsion device without generating a thrust from a main propulsion device is known in general. Such a marine vessel is disclosed in Japanese Patent Laid-Open No. 2019-199148, for example.

Japanese Patent Laid-Open No. 2019-199148 discloses a marine vessel including a hull, a plurality of propulsion units to provide a propulsive force for the hull, and a control device to control driving of the plurality of propulsion units. In the marine vessel described in Japanese Patent Laid-Open No. 2019-199148, the plurality of propulsion units include a first propulsion unit (main propulsion device) driven by an internal combustion engine and second propulsion units (auxiliary propulsion devices) each having a maximum output smaller than that of the first propulsion unit and driven by an electric motor. In the marine vessel described in Japanese Patent Laid-Open No. 2019-199148, the control device performs a control to drive only the second propulsion units of the plurality of propulsion units when a vessel operator performs an operation to select a second drive mode. Thus, in the second drive mode, motorized forward-rearward movement is able to be performed to drive the second propulsion units without generating a thrust from the first propulsion unit. The second drive mode is used when exhaust gas and noise from the internal combustion engine cause problems. In the marine vessel described in Japanese Patent Laid-Open No. 2019-199148, the same number of second propulsion units are provided on the port side and the starboard side in consideration of the right-left balance of the propulsive force of the hull.

Although not described in Japanese Patent Laid-Open No. 2019-199148, in a conventional marine vessel as described in Japanese Patent Laid-Open No. 2019-199148, auxiliary propulsion devices may be provided to one side in a right-left direction. In such a case, when motorized forward-rearward movement is performed by the auxiliary propulsion devices that are provided to one side of a hull in the right-left direction without generating a thrust from a main propulsion device, the hull is rotated due to the auxiliary propulsion devices being provided to one side of the hull in the right-left direction. That is, the motorized forward-rearward movement is not performed as intended by a vessel operator. Therefore, it is desired to perform the motorized forward-rearward movement by the auxiliary propulsion devices provided to one side of the hull in the right-left direction of the hull without generating a thrust from the main propulsion device, as intended by the vessel operator. In this description, the terms "the hull is rotated", "rotation of the hull", "rotate the hull", etc. indicate changing the orientation of the bow while maintaining the position of the hull, unlike turning of the hull accompanied by forward or rearward movement of the hull.

SUMMARY OF THE INVENTION

Preferred embodiments of the present invention provide marine propulsion systems and marine vessels that each perform motorized forward-rearward movement by auxiliary propulsion devices provided to one side of hulls in a right-left direction without generating thrusts from main propulsion devices, as intended by vessel operators.

A marine propulsion system according to a preferred embodiment of the present invention includes a main propulsion device to be attached to a stern of a hull, including an engine to drive a main thruster to generate a thrust, and operable to rotate in a right-left direction to change a direction of the thrust, an auxiliary propulsion device to be attached to the stern, including an electric motor to drive an auxiliary thruster to generate a thrust, operable to rotate in the right-left direction to change a direction of the thrust, and having a maximum output smaller than a maximum output of the main propulsion device, an operator, and a controller configured or programmed to control driving of the main propulsion device and the auxiliary propulsion device based on a predetermined operation on the operator. The auxiliary propulsion device is provided to one side of the hull in the right-left direction, and the controller is configured or programmed to perform a rudder angle change control to change a rudder angle of the auxiliary propulsion device by a predetermined angle to one side in the right-left direction of the hull with respect to a forward-rearward direction of the hull so as to move the hull along the forward-rearward direction without rotating the hull when motorized forward-rearward movement is performed to move the hull along the forward-rearward direction by driving the auxiliary propulsion device without generating the thrust from the main propulsion device.

In a marine propulsion system according to a preferred embodiment of the present invention, the controller is configured or programmed to perform the rudder angle change control to change the rudder angle of the auxiliary propulsion device by the predetermined angle to one side in the right-left direction of the hull with respect to the forward-rearward direction of the hull so as to move the hull along the forward-rearward direction without rotating the hull when the motorized forward-rearward movement is performed to move the hull along the forward-rearward direction by driving the auxiliary propulsion device that is provided to one side of the hull in the right-left direction without generating a thrust from the main propulsion device. Accordingly, the rudder angle change control is performed when the motorized forward-rearward movement is performed by the auxiliary propulsion device that is provided to one side of the hull in the right-left direction without generating a thrust from the main propulsion device such that check helm is automatically performed to prevent rotation of the hull due to the auxiliary propulsion device being provided to one side of the hull in the right-left direction. Consequently, the motorized forward-rearward movement is performed as intended by a vessel operator by the auxiliary propulsion device that is provided to one side of the hull in the right-left direction without generating a thrust from the main propulsion device.

A marine propulsion system according to a preferred embodiment of the present invention performs the motorized forward-rearward movement to move the hull along the forward-rearward direction without rotating the hull by driving the auxiliary propulsion device including the electric motor without generating a thrust from the main propulsion device including the engine. Accordingly, unlike the engine, the electric motor does not directly emit carbon dioxide, and thus a preferable device structure is achieved from the viewpoint of SDGs (Sustainable Development Goals).

In a marine propulsion system according to a preferred embodiment of the present invention, the controller is preferably configured or programmed to perform a calibration control to adjust the predetermined angle according to at least one of a shape of the hull, a size of the hull, and attachment positions of the main propulsion device and the auxiliary propulsion device to the hull. Accordingly, the calibration control is performed such that the predetermined angle by which the rudder angle of the auxiliary propulsion device is turned to move the hull along the forward-rearward direction when the motorized forward-rearward movement is performed is adjusted according to the shape of the hull, size of the hull, and/or the attachment positions of the main propulsion device and the auxiliary propulsion device to the hull, etc.

In a marine propulsion system according to a preferred embodiment of the present invention, the controller is preferably configured or programmed to perform a control to perform the motorized forward-rearward movement while a rudder angle of the main propulsion device is maintained in the forward-rearward direction of the hull. Accordingly, it is not necessary to change the rudder angle of the main propulsion device each time the motorized forward-rearward movement is performed, and thus the hull is prevented from turning due to a change in the rudder angle of the main propulsion device.

In a marine propulsion system according to a preferred embodiment of the present invention, the operator preferably includes a joystick, and the controller is preferably configured or programmed to perform the rudder angle change control when the joystick is tilted in the forward-rearward direction in an electric drive mode in which the motorized forward-rearward movement is possible. Accordingly, the operating direction (forward-rearward direction) of the joystick is the same as the moving direction (forward-rearward direction) of the hull, and thus in the electric drive mode, the joystick is operated in an intuitively easy-to-understand state to move the hull along the forward-rearward direction.

In such a case, the controller is preferably configured or programmed to perform a control to shift to the electric drive mode when the joystick is in a neutral state in a joystick mode in which the driving of the main propulsion device and the auxiliary propulsion device is controlled based on an operation on the joystick, or when a non-joystick mode is on in which the driving of the main propulsion device and the auxiliary propulsion device is controlled based on an operation on the operator other than the joystick. Accordingly, the marine propulsion system shifts to the electric drive mode only when the joystick is not operated, and thus erroneous transition to the electric drive mode during control of driving of the main propulsion device and the auxiliary propulsion device based on an operation on the joystick is prevented.

A marine propulsion system according to a preferred embodiment of the present invention preferably further includes a battery to supply power to the electric motor of the auxiliary propulsion device, and the controller is preferably configured or programmed to not perform a control to shift to an electric drive mode in which the motorized forward-rearward movement is possible when a remaining amount of the battery is smaller than a predetermined threshold. Accordingly, transition to the electric drive mode in a state in which the motorized forward-rearward movement is performed only for a relatively short time due to low battery or in a state in which the motorized forward-rearward movement is not possible is prevented.

In a marine propulsion system according to a preferred embodiment of the present invention, the operator preferably includes a joystick, and the controller is preferably configured or programmed to perform a control to move the hull laterally and diagonally by driving both the main propulsion device and the auxiliary propulsion device when the joystick is tilted laterally and diagonally in an electric drive mode in which the motorized forward-rearward movement is possible, respectively. Accordingly, the operating direction (lateral direction and diagonal direction) of the joystick is the same as the moving direction (lateral direction and diagonal direction) of the hull, and thus in the electric drive mode, the joystick is operated in an intuitively easy-to-understand state to move the hull laterally and diagonally.

In such a case, the controller is preferably configured or programmed to not perform a control to move the hull laterally and diagonally even when the joystick is tilted laterally and diagonally when the engine is stopped in the electric drive mode. Accordingly, in the electric drive mode, the engine is stopped when a control to move the hull laterally and diagonally is not performed as in a case of the motorized forward-rearward movement.

In a marine propulsion system including the controller configured or programmed to not perform a control to move the hull laterally and diagonally when the engine is stopped in the electric drive mode, the controller is preferably configured or programmed to perform a control to notify a vessel operator that the engine is stopped when the engine is stopped in the electric drive mode. Accordingly, when the engine is stopped in the electric drive mode, the vessel operator easily recognizes from the notification that the hull is not able to be moved laterally and diagonally even when the joystick is tilted laterally and diagonally.

In a marine propulsion system according to a preferred embodiment of the present invention, the operator preferably includes a joystick, and the controller is preferably configured or programmed to perform a control to rotate the hull by driving the auxiliary propulsion device without generating the thrust from the main propulsion device when the joystick is rotated in an electric drive mode in which the motorized forward-rearward movement is possible. Accordingly, the operating direction (rotating direction) of the joystick is the same as the moving direction (rotating direction) of the hull, and thus in the electric drive mode, the joystick is operated in an intuitively easy-to-understand state to rotate the hull.

In a marine propulsion system according to a preferred embodiment of the present invention, the main propulsion device is preferably an engine outboard motor including the engine to drive a main propeller corresponding to the main thruster and provided on a centerline of the hull in the right-left direction, and the auxiliary propulsion device is preferably an electric outboard motor including the electric motor to drive an auxiliary propeller corresponding to the auxiliary thruster and provided to one side of the centerline of the hull in the right-left direction. Accordingly, in a structure in which the main propulsion device and the auxiliary propulsion device are an engine outboard motor and an electric outboard motor, respectively, the motorized forward-rearward movement is performed as intended by the vessel operator by the auxiliary propulsion device that is provided to one side of the hull in the right-left direction without generating a thrust from the main propulsion device.

A marine vessel according to a preferred embodiment of the present invention includes a hull, and a marine propulsion system provided on or in the hull. The marine propulsion system includes a main propulsion device attached to a stern of the hull, including an engine to drive a main thruster to generate a thrust, and operable to rotate in a right-left direction to change a direction of the thrust, an auxiliary propulsion device attached to the stern, including an electric motor to drive an auxiliary thruster to generate a thrust, operable to rotate in the right-left direction to change a direction of the thrust, and having a maximum output smaller than a maximum output of the main propulsion device, an operator, and a controller configured or programmed to control driving of the main propulsion device and the auxiliary propulsion device based on a predetermined operation on the operator. The auxiliary propulsion device is provided to one side of the hull in the right-left direction, and the controller is configured or programmed to perform a rudder angle change control to change a rudder angle of the auxiliary propulsion device by a predetermined angle to one side in the right-left direction of the hull with respect to a forward-rearward direction of the hull so as to move the hull along the forward-rearward direction without rotating the hull when motorized forward-rearward movement is performed to move the hull along the forward-rearward direction by driving the auxiliary propulsion device without generating the thrust from the main propulsion device.

In a marine vessel according to a preferred embodiment of the present invention, the controller is configured or programmed to perform the rudder angle change control to change the rudder angle of the auxiliary propulsion device by the predetermined angle to one side in the right-left direction of the hull with respect to the forward-rearward direction of the hull so as to move the hull along the forward-rearward direction without rotating the hull when the motorized forward-rearward movement is performed to move the hull along the forward-rearward direction by driving the auxiliary propulsion device that is provided to one side of the hull in the right-left direction without generating a thrust from the main propulsion device. Accordingly, similarly to the marine propulsion systems according to preferred embodiments of the present invention described above, the motorized forward-rearward movement is performed as intended by a vessel operator by the auxiliary propulsion device that is provided to one side of the hull in the right-left direction without generating a thrust from the main propulsion device.

A marine vessel according to a preferred embodiment of the present invention performs the motorized forward-rearward movement to move the hull along the forward-rearward direction by driving the auxiliary propulsion device including the electric motor without generating a thrust from the main propulsion device including the engine. Accordingly, similarly to the marine propulsion systems according to preferred embodiments of the present invention described above, a preferable device structure is achieved from the viewpoint of SDGs.

In a marine vessel according to a preferred embodiment of the present invention, the controller is preferably configured or programmed to perform a calibration control to adjust the predetermined angle according to at least one of a shape of the hull, a size of the hull, and attachment positions of the main propulsion device and the auxiliary propulsion device to the hull. Accordingly, similarly to the marine propulsion systems according to preferred embodiments of the present invention described above, the calibration control is performed such that the predetermined angle by which the rudder angle of the auxiliary propulsion device is changed to move the hull along the forward-rearward direction when the motorized forward-rearward movement is performed is adjusted according to the shape of the hull, the size of the hull, and/or the attachment positions of the main propulsion device and the auxiliary propulsion device to the hull, etc.

In a marine vessel according to a preferred embodiment of the present invention, the controller is preferably configured or programmed to perform a control to perform the motorized forward-rearward movement while a rudder angle of the main propulsion device is maintained in the forward-rearward direction of the hull. Accordingly, similarly to the marine propulsion systems according to preferred embodiments of the present invention described above, the hull is prevented from turning due to a change in the rudder angle of the main propulsion device.

In a marine vessel according to a preferred embodiment of the present invention, the operator preferably includes a joystick, and the controller is preferably configured or programmed to perform the rudder angle change control when the joystick is tilted in the forward-rearward direction in an electric drive mode in which the motorized forward-rearward movement is possible. Accordingly, similarly to the marine propulsion systems according to preferred embodiments of the present invention described above, in the electric drive mode, the joystick is operated in an intuitively easy-to-understand state to move the hull along the forward-rearward direction.

In such a case, the controller is preferably configured or programmed to perform a control to shift to the electric drive mode when the joystick is in a neutral state in a joystick mode in which the driving of the main propulsion device and the auxiliary propulsion device is controlled based on an operation on the joystick, or when a non-joystick mode is on in which the driving of the main propulsion device and the auxiliary propulsion device is controlled based on an operation on the operator other than the joystick. Accordingly, similarly to the marine propulsion systems according to preferred embodiments of the present invention described above, erroneous transition to the electric drive mode during control of driving of the main propulsion device and the auxiliary propulsion device based on an operation on the joystick is prevented.

A marine vessel according to a preferred embodiment of the present invention preferably further includes a battery to supply power to the electric motor of the auxiliary propulsion device, and the controller is preferably configured or programmed to not perform a control to shift to an electric drive mode in which the motorized forward-rearward movement is possible when a remaining amount of the battery is smaller than a predetermined threshold. Accordingly, similarly to the marine propulsion systems according to preferred embodiments of the present invention described above, transition to the electric drive mode in a state in which the motorized forward-rearward movement is performed only for a relatively short time due to low battery or in a state in which the motorized forward-rearward movement is not possible is prevented.

In a marine vessel according to a preferred embodiment of the present invention, the operator preferably includes a joystick, and the controller is preferably configured or programmed to perform a control to move the hull laterally and diagonally by driving both the main propulsion device and the auxiliary propulsion device when the joystick is tilted laterally and diagonally in an electric drive mode in which the motorized forward-rearward movement is possible, respectively. Accordingly, similarly to the marine propulsion systems according to preferred embodiments of the present invention described above, in the electric drive mode, the joystick is operated in an intuitively easy-to-understand state to move the hull laterally and diagonally.

In such a case, the controller is preferably configured or programmed to not perform a control to move the hull laterally and diagonally even when the joystick is tilted laterally and diagonally when the engine is stopped in the electric drive mode. Accordingly, similarly to the marine propulsion systems according to preferred embodiments of the present invention described above, in the electric drive mode, the engine is stopped when a control to move the hull laterally and diagonally is not performed as in a case of the motorized forward-rearward movement.

In a marine vessel including the controller configured or programmed to not perform a control to move the hull laterally and diagonally when the engine is stopped in the electric drive mode, the controller is preferably configured or programmed to perform a control to notify a vessel operator that the engine is stopped when the engine is stopped in the electric drive mode. Accordingly, similarly to the marine propulsion systems according to preferred embodiments of the present invention described above, when the engine is stopped in the electric drive mode, the vessel operator easily recognizes from the notification that the hull is not able to be moved laterally and diagonally even when the joystick is tilted laterally and diagonally.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 7 is a diagram illustrating an engine drive mode and an electric drive mode in a marine propulsion system according to a preferred embodiment of the present invention.

FIG. 8 is a schematic view showing movement along a forward-rearward direction in an electric drive mode of a marine propulsion system according to a preferred embodiment of the present invention.

DETAILED DESCRIPTION OF THE PREFERRED EMBODIMENTS

Preferred embodiments of the present invention are hereinafter described with reference to the drawings.

The structures of a marine propulsion system 100 and a marine vessel 110 according to preferred embodiments of the present invention are now described with reference to FIGS. 1 to 8. In the figures, arrow FWD represents the front of the marine vessel 110, arrow BWD represents the rear of the marine vessel 110, arrow L represents the left (port side) of the marine vessel 110, and arrow R represents the right (starboard side) of the marine vessel 110.

Figure 1:
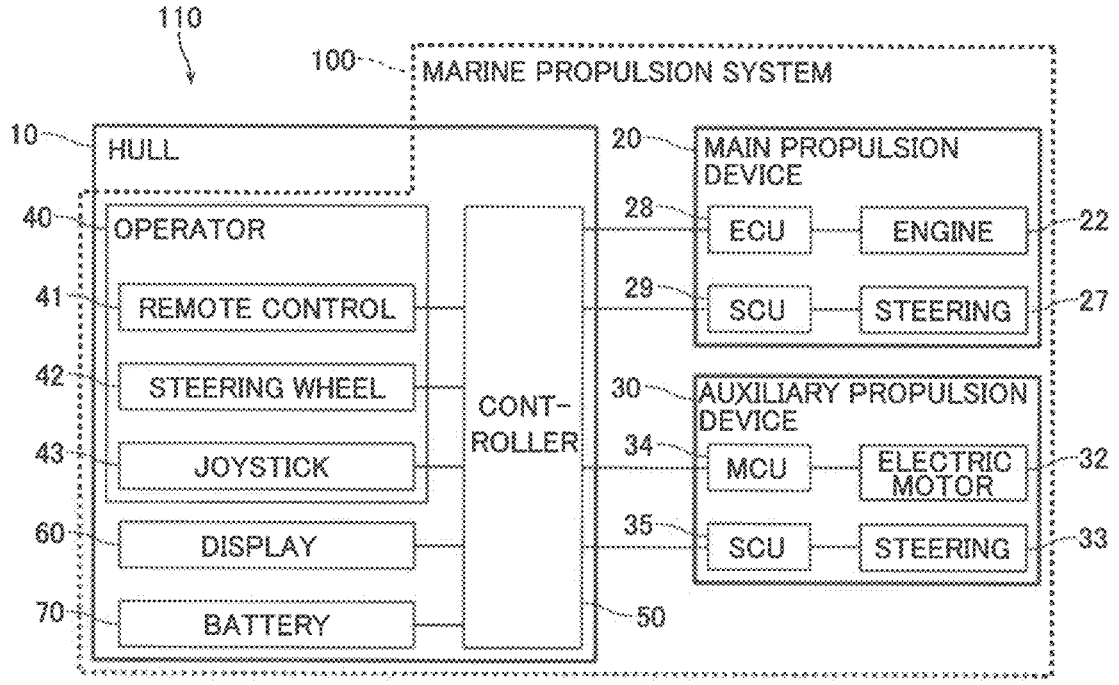
FIG. 1 is a block diagram showing a marine propulsion system according to a preferred embodiment of the present invention.

As shown in FIG. 1, the marine vessel 110 includes a hull 10 and the marine propulsion system 100. The marine propulsion system 100 is provided on or in the hull 10. The marine propulsion system 100 propels the marine vessel 110. The marine vessel 110 may be a relatively small marine vessel used for sightseeing or fishing, for example.

The marine propulsion system 100 includes a main propulsion device 20, an auxiliary propulsion device 30, an operator 40, a controller 50, a display 60, and a battery 70. The operator 40, the controller 50, the display 60, and the battery 70 are provided on or in the hull 10.

Figure 2:
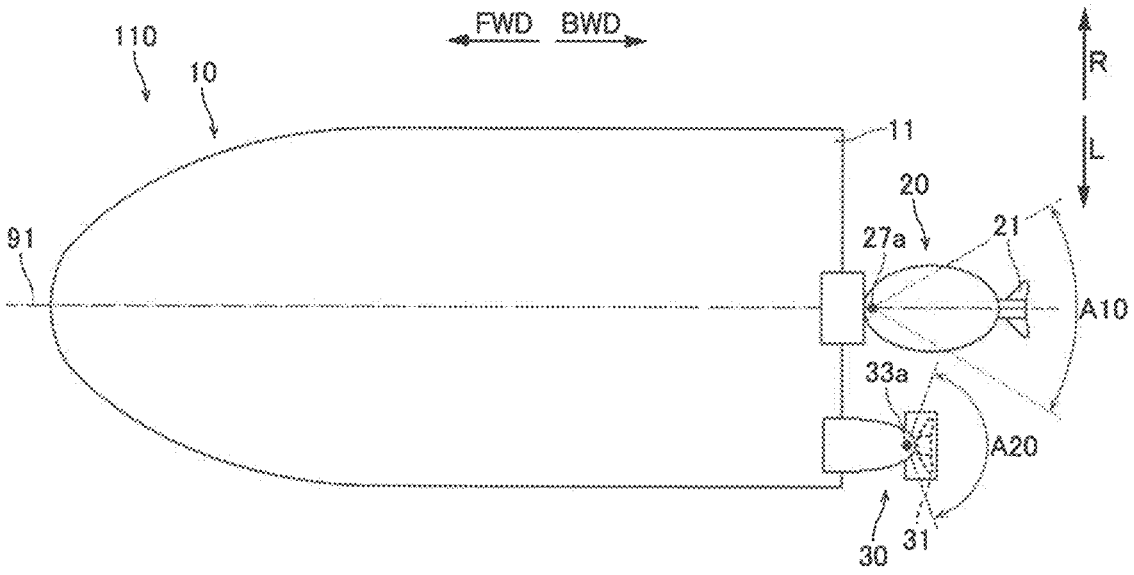
FIG. 2 is a schematic view showing a marine vessel according to a preferred embodiment of the present invention.

As shown in FIG. 2, only one main propulsion device 20 is attached to a stern 11 of the hull 10. The main propulsion device 20 is located on a centerline 91 of the hull 10 in a right-left direction.

Figure 3:
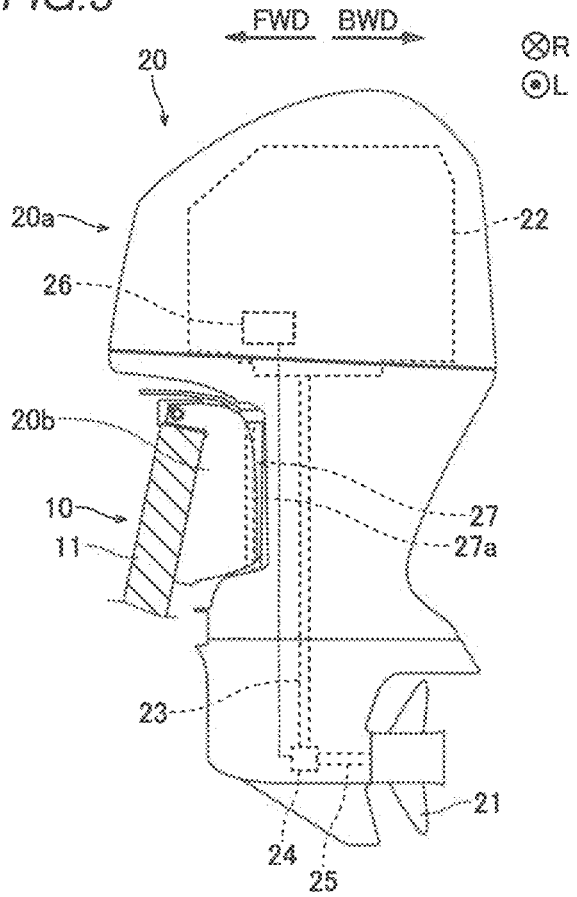
FIG. 3 is a side view showing a main propulsion device of a marine vessel according to a preferred embodiment of the present invention.

As shown in FIG. 3, the main propulsion device 20 includes a main propulsion device main body 20*a* and a bracket 20*b*. The main propulsion device main body 20*a* is attached to the stern 11 of the hull 10 via the bracket 20*b*.

The main propulsion device 20 is an engine outboard motor including an engine 22 to drive a main propeller 21 that generates a thrust. Specifically, the main propulsion device main body 20*a* includes the engine 22, a drive shaft 23, a gearing 24, a propeller shaft 25, and the main propeller 21. The engine 22 is an internal combustion engine that generates a driving force. The driving force of the engine 22 is transmitted to the main propeller 21 via the drive shaft 23, the gearing 24, and the propeller shaft 25. The main propeller 21 generates a thrust by rotating in the water by the driving force transmitted from the engine 22. The main propeller 21 is an example of a "main thruster".

The main propulsion device main body 20*a* includes a shift actuator 26 that switches the shift state of the main propulsion device 20. The shift actuator 26 switches the shift state of the main propulsion device 20 between a forward movement state, a rearward movement state, and a neutral state by switching the meshing of the gearing 24. In the forward movement state, a driving force is transmitted from the engine 22 to the main propeller 21 to generate a forward thrust from the main propeller 21. In the rearward movement state, a driving force is transmitted from the engine 22 to the main propeller 21 to generate a rearward thrust from the main propeller 21. In the neutral state, a driving force is not transmitted from the engine 22 to the main propeller 21 in order to not generate a thrust in the main propeller 21. In the main propulsion device 20, when the shift state of the main propulsion device 20 is switched, the gearing 24 generates relatively loud noises and vibrations.

The main propulsion device 20 rotates in the right-left direction to change the direction of a thrust.

Specifically, a steering 27 is provided on the bracket 20*b*. The steering 27 includes a steering shaft 27*a* that extends in an upward-downward direction. The main propulsion device main body 20*a* is rotated in the right-left direction by the steering 27 about the steering shaft 27*a* with respect to the bracket 20*b*. When the main propulsion device main body 20*a* rotates in the right-left direction about the steering shaft 27*a*, the orientation of the main propeller 21 also rotates in the right-left direction. Thus, the direction of the thrust of the main propeller 21 is changed. In the following description, changing the direction of the thrust of the main propeller 21 by rotating the orientation of the main propeller 21 in the right-left direction is referred to as "steering the main propulsion device 20".

As shown in FIG. 2, the main propulsion device 20 is steerable by about 30 degrees to each of the L side and the R side. That is, a steering angle range A10, which is an angular range in which the main propulsion device 20 is steerable, is about 60 degrees.

As shown in FIG. 1, the main propulsion device 20 includes an engine control unit (ECU) 28 and a steering control unit (SCU) 29. The ECU 28 controls driving of the engine 22 and driving of the shift actuator 26 based on a control performed by the controller 50. The SCU 29 controls driving of the steering 27 based on a control performed by the controller 50. The ECU 28 and the SCU 29 include a control circuit including a central processing unit (CPU), for example.

As shown in FIG. 2, only one auxiliary propulsion device 30 is attached to the stern 11 of the hull 10. The auxiliary propulsion device 30 is provided to one side of the hull 10 in the right-left direction. In the marine propulsion system 100, the auxiliary propulsion device 30 is provided to the L side of the hull 10, and no auxiliary propulsion device is provided to the R side of the hull 10.

Figure 4:
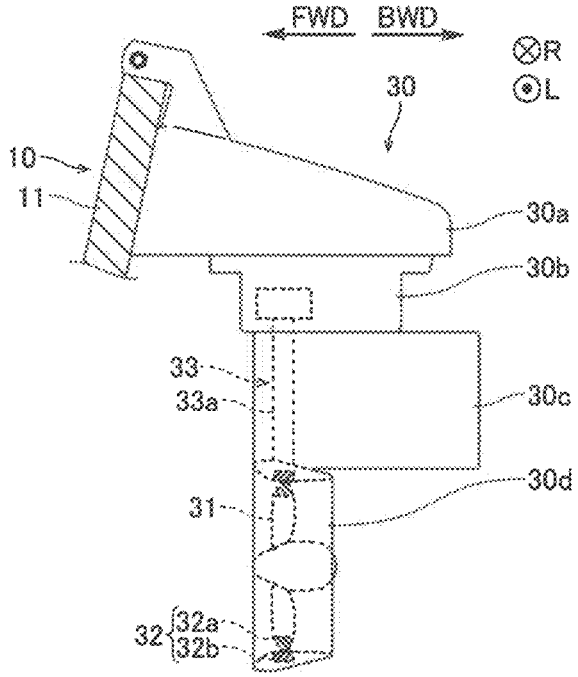
FIG. 4 is a side view showing an auxiliary propulsion device of a marine vessel according to a preferred embodiment of the present invention.

As shown in FIG. 4, the auxiliary propulsion device 30 includes a cowling 30*a*, an upper case 30*b*, a lower case 30*c*, and a duct 30*d*. The cowling 30*a*, the upper case 30*b*, the lower case 30*c*, and the duct 30*d* are aligned in this order from top to bottom. The cowling 30*a* is attached to the stern 11 of the hull 10.

The auxiliary propulsion device 30 is preferably an electric outboard motor including an electric motor 32 to drive an auxiliary propeller 31 that generates a thrust. Specifically, the auxiliary propulsion device 30 includes the electric motor 32 and the auxiliary propeller 31. The electric motor 32 is provided in the duct 30*d*. The auxiliary propeller 31 is provided in the duct 30*d*. The electric motor 32 is driven by power supplied from the battery 70 provided in the hull 10. The electric motor 32 includes a stator 32*a* that is integral and unitary with the duct 30*d*, and a rotor 32*b* that is integral and unitary with the auxiliary propeller 31. The auxiliary propeller 31 generates a thrust by rotating in the water by a driving force transmitted from the electric motor 32. The auxiliary propeller 31 is an example of an "auxiliary thruster".

When the auxiliary propeller 31 is rotated forward, a forward thrust is generated from the auxiliary propeller 31. When the auxiliary propeller 31 is rotated backward, a rearward thrust is generated from the auxiliary propeller 31. When the auxiliary propeller 31 is stopped, a thrust is not generated from the auxiliary propeller 31. That is, in the auxiliary propulsion device 30, it is not necessary to switch the meshing of the gearing 24 (see FIG. 3) unlike the main propeller 21 (see FIG. 3) of the main propulsion device 20 (see FIG. 3). Thus, the auxiliary propulsion device 30 does not generate relatively loud noises or vibrations unlike the main propulsion device 20.

The auxiliary propulsion device 30 rotates in the right-left direction to change the direction of a thrust. Specifically, a steering 33 is provided in the auxiliary propulsion device 30. The steering 33 includes a steering shaft 33*a* fixed to the lower case 30*c* and extending in the upward-downward direction. An upper end of the steering shaft 33*a* is located in the upper case 30*b*. A lower end of the steering shaft 33*a* is fixed to the duct 30*d*. The duct 30*d* and the lower case 30*c* are rotatable in the right-left direction by the steering 33 about the steering shaft 33*a* with respect to the cowling 30*a* and the upper case 30*b*. When the duct 30*d* rotates in the right-left direction about the steering shaft 33*a*, the orientation of the auxiliary propeller 31 also rotates in the right-left direction. Thus, the direction of the thrust of the auxiliary propeller 31 is changed. In the following description, changing the direction of the thrust of the auxiliary propeller 31 by rotating the orientation of the auxiliary propeller 31 in the right-left direction is referred to as "steering the auxiliary propulsion device 30".

As shown in FIG. 2, the auxiliary propulsion device 30 is steerable by about 70 degrees to each of the L side and the R side. That is, a steering angle range A20, which is an angular range in which the auxiliary propulsion device 30 is steerable, is about 140 degrees.

As shown in FIG. 1, the auxiliary propulsion device 30 includes a motor control unit (MCU) 34 and a steering control unit (SCU) 35. The MCU 34 and the SCU 35 include a control circuit including a CPU, for example. The MCU 34 controls driving of the electric motor 32 based on a control performed by the controller 50. The SCU 35 controls driving of the steering 33 based on a control performed by the controller 50.

Figure 5:
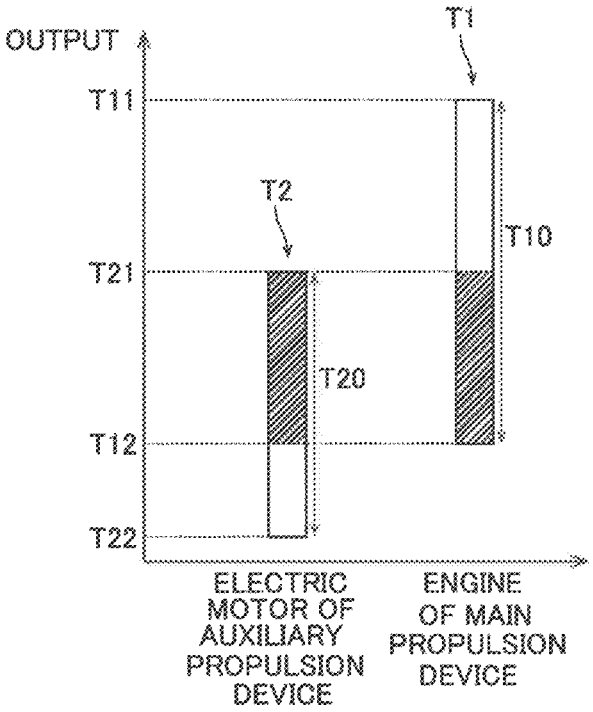
FIG. 5 is a diagram showing a power range of an engine of a main propulsion device and a power range of an electric motor of an auxiliary propulsion device according to a preferred embodiment of the present invention.

As shown in FIG. 5, the maximum output of the auxiliary propulsion device 30 is smaller than that of the main propulsion device 20. Specifically, the maximum value T11 and the minimum value T12 of the power range T10 of the engine 22 of the main propulsion device 20 are larger than the maximum value T21 and the minimum value T22 of the power range T20 of the electric motor 32 of the auxiliary propulsion device 30, respectively. The minimum value T12 of the power range T10 of the engine 22 is smaller than the maximum value T21 of the power range T20 of the electric motor 32. That is, the power range T10 of the engine 22 of the main propulsion device 20 and the power range T20 of the electric motor 32 of the auxiliary propulsion device 30 overlap each other between the maximum value T21 of the power range T20 of the electric motor 32 and the minimum value T12 of the power range T10 of the engine 22.

As shown in FIG. 1, the operator 40 receives a user's operation in order to operate (maneuver) the hull 10. The operator 40 includes a remote control 41, a steering wheel 42, and a joystick 43. The joystick 43 is an example of an "operator".

The remote control 41 includes a lever. The steering wheel 42 is rotatable. The hull 10 is operated by combining an operation on the lever of the remote control 41 and an operation to rotate the steering wheel 42.

Figure 6:
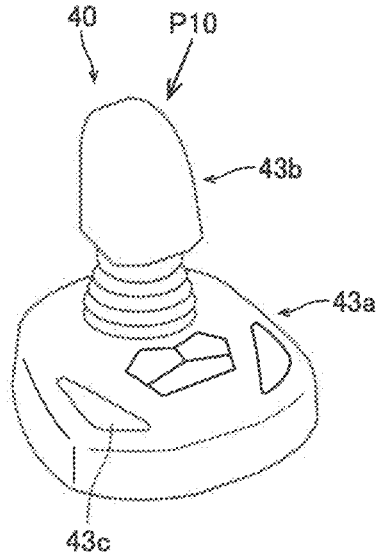
FIG. 6 is a diagram showing a joystick of a marine vessel according to a preferred embodiment of the present invention.

As shown in FIG. 6, the joystick 43 includes a base 43*a* and a lever 43*b*. The lever 43*b* is tiltably and rotatably attached to the base 43*a*. The lever 43*b* is urged by an urging member such as a spring to automatically return to a neutral position P10 when not operated by the user. At the neutral position P10, the lever 43*b* is upright and is not rotated.

Operations on the joystick 43 are roughly divided into three operations: an operation to tilt the lever 43*b*, an operation to tilt and rotate the lever 43*b*, and an operation to rotate the lever 43*b*. The operation to tilt the lever 43*b* corresponds to an operation to translate the hull 10 (see FIG. 1). The translation includes forward and rearward movements, lateral movements, and diagonal movements. The operation to tilt and rotate the lever 43*b* corresponds to an operation to turn the hull 10. The turning includes clockwise turning and counterclockwise turning. The operation to rotate the lever 43*b* corresponds to an operation to rotate the hull 10. In the following description, for convenience of explanation, "tilting the lever 43*b*" and "rotating the lever 43*b*" are referred to as "tilting the joystick 43" and "rotating the joystick 43", respectively.

A joystick mode switch 43*c* is provided on the base 43*a* of the joystick 43. In the marine propulsion system 100, the joystick mode switch 43*c* is pressed to switch between a state in which the controller 50 controls driving of the main propulsion device 20 and driving of the auxiliary propulsion device 30 based on an operation on the joystick 43 (joystick mode) and a state in which the controller 50 controls driving of the main propulsion device 20 and driving of the auxiliary propulsion device 30 based on operations on the remote control 41 and the steering wheel 42 (non-joystick mode). When the marine propulsion system 100 is in the joystick mode, operations on the remote control 41 and the steering wheel 42 are not received. When the marine propulsion system 100 is in the non-joystick mode, an operation on the joystick 43 is not received.

As shown in FIG. 1, the controller 50 controls the ECU 28 of the main propulsion device 20, the SCU 29 of the main propulsion device 20, the MCU 34 of the auxiliary propulsion device 30, and the SCU 29 of the auxiliary propulsion device 30 based on an operation on the operator 40. That is, the controller 50 controls driving of the main propulsion device 20 and driving of the auxiliary propulsion device 30 based on a predetermined operation on the operator 40. The controller 50 includes a control circuit including a CPU, for example. The marine propulsion system 100 includes an engine drive mode in which the hull 10 is moved in the forward-rearward direction by driving the main propulsion device 20 corresponding to an engine outboard motor, and an electric drive mode in which the hull 10 is moved in the forward-rearward direction by driving the auxiliary propulsion device 30 corresponding to an electric outboard motor.

As shown in FIG. 7, when the joystick 43 is operated to move the hull 10 along the forward-rearward direction (the joystick 43 is tilted in the forward-rearward direction) in the engine drive mode, the controller 50 controls driving of the main propulsion device 20 to move the hull 10 along the forward-rearward direction. On the other hand, when the joystick 43 is operated to move the hull 10 along the forward-rearward direction in the electric drive mode, the controller 50 controls driving of the auxiliary propulsion device 30 to move the hull 10 along the forward-rearward direction. That is, when the joystick 43 is operated to move the hull 10 along the forward-rearward direction in the electric drive mode, motorized forward-rearward movement is performed to move the hull 10 along the forward-rearward direction by driving the auxiliary propulsion device 30 without generating a thrust from the main propulsion device 20. The motorized forward-rearward movement is described below in detail.

When the joystick 43 is operated to move the hull 10 laterally and diagonally (the joystick 43 is tilted laterally and diagonally) in each of the engine drive mode and the electric drive mode, the controller 50 controls driving of the main propulsion device 20 and driving of the auxiliary propulsion device 30 to move the hull 10 laterally and diagonally. That is, the controller 50 performs a control to move the hull 10 laterally and diagonally by driving both the main propulsion device 20 and the auxiliary propulsion device 30 when the joystick 43 is tilted laterally and diagonally in the electric drive mode in which the motorized forward-rearward movement is possible, respectively.

When the engine 22 is stopped, the controller 50 does not perform a control to move the hull 10 laterally and diagonally even when the joystick 43 is tilted laterally and diagonally in the electric drive mode. Specifically, when the joystick 43 is tilted laterally and diagonally in the electric drive mode, the controller 50 determines whether or not the engine 22 is stopped. When the engine 22 is stopped, the controller 50 does not perform a control to move the hull 10 laterally and diagonally. On the other hand, when the engine 22 is operating, the controller 50 performs a control to move the hull 10 laterally and diagonally. The controller 50 performs a control to notify a vessel operator that the engine 22 is stopped when the engine 22 is stopped in the electric drive mode. The notification that the engine 22 is stopped may be displayed on the display 60, or may be made by generating a sound, for example.

When the joystick 43 is operated to rotate the hull 10 (the joystick 43 is rotated) in each of the engine drive mode and the electric drive mode, the controller 50 controls driving of the auxiliary propulsion device 30 to rotate the hull 10. That is, the controller 50 performs a control to rotate the hull 10 by driving the auxiliary propulsion device 30 without generating a thrust from the main propulsion device 20 when the joystick 43 is rotated in the electric drive mode in which the motorized forward-rearward movement is possible.

The controller 50 performs a control to switch between the engine drive mode and the electric drive mode when an operation is performed to switch between the engine drive mode and the electric drive mode. For example, the display 60 (see FIG. 1) may be a touch panel, and a button (hereinafter referred to as a mode switching button) displayed on the display 60 may be touched to switch between the engine drive mode and the electric drive mode. Alternatively, a mode switching button may be provided on the joystick 43 and be operated to switch between the engine drive mode and the electric drive mode. Alternatively, a mode switching button may be provided in the vicinity of or adjacent to a vessel operator's seat of the hull 10 and be operated to switch between the engine drive mode and the electric drive mode.

The controller 50 performs a control to shift to the electric drive mode when the joystick 43 is in a neutral state in the joystick mode or when the non-joystick mode is on. Specifically, when an operation is performed to switch between the engine drive mode and the electric drive mode in the engine drive mode, the controller 50 determines whether or not the marine propulsion system 100 (see FIG. 1) is in the joystick mode and the joystick 43 is in the neutral state. When the marine propulsion system 100 is in the joystick mode and the joystick 43 is in the neutral state, the controller 50 performs a control to shift from the engine drive mode to the electric drive mode. On the other hand, when the marine propulsion system 100 is not in the joystick mode or the joystick 43 is not in the neutral state, the controller 50 does not perform a control to shift from the engine drive mode to the electric drive mode. The marine propulsion system 100 performs a similar control when the electric drive mode is switched to the engine drive mode.

The controller 50 does not perform a control to shift to the electric drive mode in which the motorized forward-rearward movement is possible when the remaining amount of the battery 70 (see FIG. 1) is smaller than a predetermined threshold. Specifically, when an operation is performed to switch between the engine drive mode and the electric drive mode in the engine drive mode, the controller 50 determines whether or not the remaining amount of the battery 70 is smaller than the predetermined threshold. When the remaining amount of the battery 70 is smaller than the predetermined threshold, the controller 50 does not perform a control to shift from the engine drive mode to the electric drive mode. On the other hand, when the remaining amount of the battery 70 is equal to or larger than the predetermined threshold, the controller 50 performs a control to shift from the engine drive mode to the electric drive mode.

Figure 9:
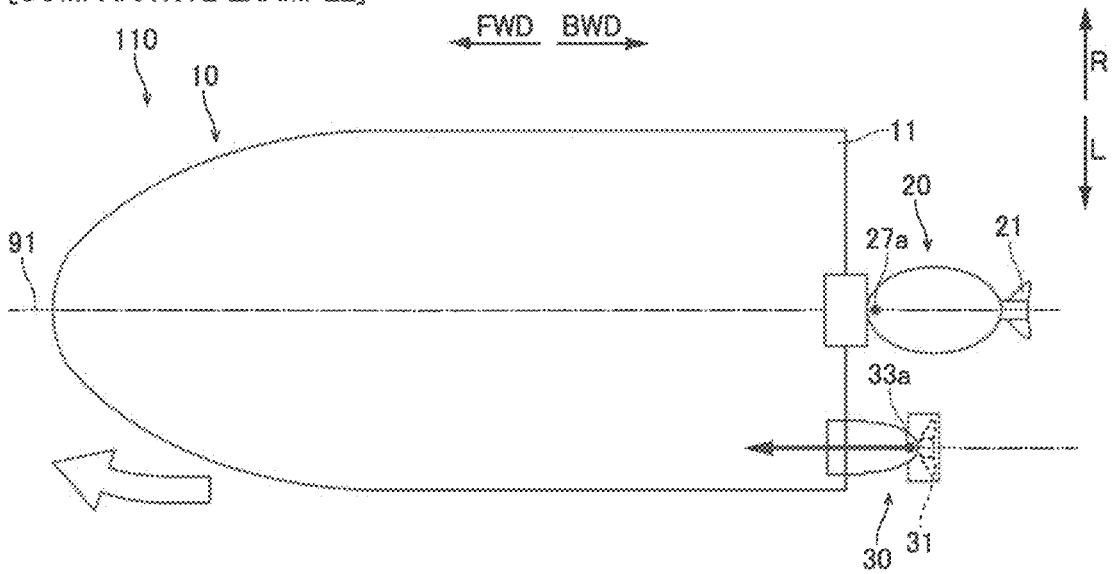
FIG. 9 is a schematic view showing movement along a forward-rearward direction in an electric drive mode of a marine propulsion system according to a comparative example of the present invention.

As shown in FIG. 8, the controller 50 (see FIG. 1) performs a rudder angle change control to change the rudder angle A2 of the auxiliary propulsion device 30 by a predetermined angle $\alpha$ to one side (L side) in the right-left direction of the hull 10 with respect to the forward-rearward direction of the hull 10 so as to move the hull 10 in the forward-rearward direction when the motorized forward-rearward movement is performed. Specifically, as shown in FIG. 9, the auxiliary propulsion device 30 is provided to one side (L side) in the right-left direction of the hull 10, and thus the hull 10 is turned when a thrust is generated in the forward-rearward direction from the auxiliary propulsion device 30. Therefore, as shown in FIG. 8, the rudder angle change control is performed to change the rudder angle A2 of the auxiliary propulsion device 30 by the predetermined angle $\alpha$ to one side (L side) in the right-left direction of the hull 10 with respect to the forward-rearward direction of the hull 10 such that the rudder angle A2 of the auxiliary propulsion device 30 is changed to generate a thrust from the auxiliary propulsion device 30 so as to move the hull 10 along the forward-rearward direction without rotating the hull 10. The controller 50 performs the rudder angle change control when the joystick 43 is tilted in the forward-rearward direction in the electric drive mode in which the motorized forward-rearward movement is possible.

The predetermined angle $\alpha$ that causes the auxiliary propulsion device 30 to generate a thrust to move the hull 10 along the forward-rearward direction varies depending on the shape and size of the hull 10, the attachment position of the auxiliary propulsion device 30 to the hull 10, etc. Therefore, the controller 50 (see FIG. 1) performs a calibration control to adjust the predetermined angle $\alpha$ according to the hull 10.

Specifically, in the marine vessel 110 in which the calibration control is not performed, the vessel operator tilts the joystick 43 (see FIG. 1) to move the hull 10 in the forward-rearward direction. At this time, the tilting direction of the joystick 43 is deviated from the forward-rearward direction. That is, in the marine vessel 110 in which the calibration control is not performed, the tilting direction of the joystick 43 and the moving direction of the hull 10 do not match. Then, while tilting the joystick 43 to move the hull 10 in the forward-rearward direction, the vessel operator performs an operation (pressing a calibration button, for example) to memorize the tilting direction of the joystick 43 in which the hull 10 moves in the forward-rearward direction. After that, when the joystick 43 is tilted in the forward-rearward direction, the controller 50 (see FIG. 1) controls the rudder angle A2 of the auxiliary propulsion device 30 to move the hull 10 in the forward-rearward direction. The calibration control may be performed at the time of the initial operation of the marine propulsion system 100, or after the attachment position of the auxiliary propulsion device 30 to the hull 10 is changed, for example.

When the motorized forward-rearward movement is performed, the rudder angle A1 of the main propulsion device 20 is maintained at zero. That is, the controller 50 performs a control to perform the motorized forward-rearward movement while the rudder angle A1 of the main propulsion device 20 is maintained in the forward-rearward direction of the hull 10.

According to the various preferred embodiments of the present invention described above, the following advantageous effects are achieved.

According to a preferred embodiment of the present invention, the controller 50 is configured or programmed to perform the rudder angle change control to change the rudder angle A2 of the auxiliary propulsion device 30 by the predetermined angle $\alpha$ to one side in the right-left direction of the hull 10 with respect to the forward-rearward direction of the hull 10 so as to move the hull 10 along the forward-rearward direction when the motorized forward-rearward movement is performed to move the hull 10 along the forward-rearward direction by driving the auxiliary propulsion device 30 that is provided to one side of the hull 10 in the right-left direction without generating a thrust from the main propulsion device 20. Accordingly, the rudder angle change control is performed when the motorized forward-rearward movement is performed by the auxiliary propulsion device 30 that is provided to one side of the hull 10 in the right-left direction without generating a thrust from the main propulsion device 20 such that check helm is automatically performed to prevent rotation of the hull 10 due to the auxiliary propulsion device 30 being provided to one side of the hull 10 in the right-left direction. Consequently, the motorized forward-rearward movement is performed as intended by the vessel operator by the auxiliary propulsion device 30 that is provided to one side of the hull 10 in the right-left direction without generating a thrust from the main propulsion device 20.

According to a preferred embodiment of the present invention, the marine propulsion system 100 performs the motorized forward-rearward movement to move the hull 10 along the forward-rearward direction by driving the auxiliary propulsion device 30 including the electric motor 32 without generating a thrust from the main propulsion device 20 including the engine 22. Accordingly, unlike the engine 22, the electric motor 32 does not directly emit carbon dioxide, and thus a preferable device structure is achieved from the viewpoint of SDGs.

According to a preferred embodiment of the present invention, the controller 50 is configured or programmed to perform the calibration control to adjust the predetermined angle $\alpha$ according to the hull 10. Accordingly, the calibration control is performed such that the predetermined angle $\alpha$ by which the rudder angle A2 of the auxiliary propulsion device 30 is turned to move the hull 10 along the forward-rearward direction when the motorized forward-rearward movement is performed is adjusted according to the shape and size of the hull 10, the attachment positions of the main propulsion device 20 and the auxiliary propulsion device 30 to the hull 10, etc.

According to a preferred embodiment of the present invention, the controller 50 is configured or programmed to perform a control to perform the motorized forward-rearward movement while the rudder angle A1 of the main propulsion device 20 is maintained in the forward-rearward direction of the hull 10. Accordingly, it is not necessary to change the rudder angle A1 of the main propulsion device 20 each time the motorized forward-rearward movement is performed, and thus the hull 10 is prevented from swinging due to a change in the rudder angle A1 of the main propulsion device 20.

According to a preferred embodiment of the present invention, the operator 40 includes the joystick 43. The controller 50 is configured or programmed to perform the rudder angle change control when the joystick 43 is tilted in the forward-rearward direction in the electric drive mode in which the motorized forward-rearward movement is possible. Accordingly, the operating direction (forward-rearward direction) of the joystick 43 is the same as the moving direction (forward-rearward direction) of the hull 10, and thus in the electric drive mode, the joystick 43 is operated in an intuitively easy-to-understand state to move the hull 10 along the forward-rearward direction.

According to a preferred embodiment of the present invention, the controller 50 is configured or programmed to perform a control to shift to the electric drive mode when the joystick 43 is in the neutral state in the joystick mode in which driving of the main propulsion device 20 and the auxiliary propulsion device 30 is controlled based on an operation on the joystick 43, or when the non-joystick mode is on in which driving of the main propulsion device 20 and the auxiliary propulsion device 30 is controlled based on an operation on the operator 40 other than the joystick 43. Accordingly, the marine propulsion system 100 shifts to the electric drive mode only when the joystick 43 is not operated, and thus erroneous transition to the electric drive mode during control of driving of the main propulsion device 20 and the auxiliary propulsion device 30 based on an operation on the joystick 43 is prevented.

According to a preferred embodiment of the present invention, the controller 50 is configured or programmed to not perform a control to shift to the electric drive mode in which the motorized forward-rearward movement is possible when the remaining amount of the battery 70 that supplies power to the electric motor 32 of the auxiliary propulsion device 30 is smaller than the predetermined threshold. Accordingly, transition to the electric drive mode in a state in which the motorized forward-rearward movement is performed only for a relatively short time due to low battery or in a state in which the motorized forward-rearward movement is not possible is prevented.

According to a preferred embodiment of the present invention, the operator 40 includes the joystick 43. The controller 50 is configured or programmed to perform a control to move the hull 10 laterally and diagonally by driving both the main propulsion device 20 and the auxiliary propulsion device 30 when the joystick 43 is tilted laterally and diagonally in the electric drive mode in which the motorized forward-rearward movement is possible, respectively. Accordingly, the operating direction (lateral direction and diagonal direction) of the joystick 43 is the same as the moving direction (lateral direction and diagonal direction) of the hull 10, and thus in the electric drive mode, the joystick 43 is operated in an intuitively easy-to-understand state to move the hull 10 laterally and diagonally.

According to a preferred embodiment of the present invention, the controller 50 is configured or programmed to not perform a control to move the hull 10 laterally and diagonally even when the joystick 43 is tilted laterally and diagonally when the engine 22 is stopped in the electric drive mode. Accordingly, in the electric drive mode, the engine 22 is stopped when a control to move the hull 10 laterally and diagonally is not performed as in a case of the motorized forward-rearward movement.

According to a preferred embodiment of the present invention, the controller 50 is configured or programmed to perform a control to notify the vessel operator that the engine 22 is stopped when the engine 22 is stopped in the electric drive mode. Accordingly, when the engine 22 is stopped in the electric drive mode, the vessel operator easily recognizes from the notification that the hull 10 is not able to be moved laterally and diagonally due to the engine 22 being stopped even when the joystick 43 is tilted laterally and diagonally.

According to a preferred embodiment of the present invention, the operator 40 includes the joystick 43. The controller 50 is configured or programmed to perform a control to rotate the hull 10 by driving the auxiliary propulsion device 30 without generating a thrust from the main propulsion device 20 when the joystick 43 is rotated in the electric drive mode in which the motorized forward-rearward movement is possible. Accordingly, the operating direction (rotating direction) of the joystick 43 is the same as the moving direction (rotating direction) of the hull 10, and thus in the electric drive mode, the joystick 43 is operated in an intuitively easy-to-understand state to rotate the hull 10.

According to a preferred embodiment of the present invention, the main propulsion device 20 is an engine outboard motor including the engine 22 to drive the main propeller 21 corresponding to a main thruster and provided on the centerline 91 of the hull 10 in the right-left direction. The auxiliary propulsion device 30 is an electric outboard motor including the electric motor 32 to drive the auxiliary propeller 31 corresponding to an auxiliary thruster and provided to one side of the centerline 91 of the hull 10 in the right-left direction. Accordingly, in a structure in which the main propulsion device 20 and the auxiliary propulsion device 30 are an engine outboard motor and an electric outboard motor, respectively, the motorized forward-rearward movement is performed as intended by the vessel operator by the auxiliary propulsion device 30 that is provided to one side of the hull 10 in the right-left direction without generating a thrust from the main propulsion device 20.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the main propulsion device 20 is preferably an engine outboard motor, and the auxiliary propulsion device 30 is preferably an electric outboard motor in preferred embodiments described above, the present invention is not restricted to this. In a preferred embodiment of the present invention, the main propulsion device and the auxiliary propulsion device may alternatively be inboard motors enclosed within the hull instead of outboard motors, or inboard-outboard motors partially enclosed within the hull.

While the controller 50 preferably performs a control to rotate the hull 10 by driving the auxiliary propulsion device 30 without generating a thrust from the main propulsion device 20 when the joystick 43 is rotated in the electric drive mode in which the motorized forward-rearward movement is possible in preferred embodiments described above, the present invention is not restricted to this. In a preferred embodiment of the present invention, the controller may alternatively perform a control to rotate the hull by driving the auxiliary propulsion device without generating a thrust from the main propulsion device when an operator other than the joystick is operated to rotate the hull in the electric drive mode in which the motorized forward-rearward movement.

While the controller 50 preferably performs a control to notify the vessel operator that the engine 22 is stopped when the engine 22 is stopped in the electric drive mode in preferred embodiments described above, the present invention is not restricted to this. In a preferred embodiment of the present invention, the controller may not perform a control to notify the vessel operator that the engine is stopped when the engine is stopped in the electric drive mode.

While the controller 50 preferably does not perform a control to move the hull 10 laterally and diagonally even when the joystick 43 is tilted laterally and diagonally when the engine 22 is stopped in the electric drive mode in preferred embodiments described above, the present invention is not restricted to this. In a preferred embodiment of the present invention, the controller may alternatively perform a control to move the hull laterally and diagonally when the joystick is tilted laterally and diagonally even when the engine is stopped in the electric drive mode.

While the controller 50 preferably performs a control to move the hull 10 laterally and diagonally by driving both the main propulsion device 20 and the auxiliary propulsion device 30 when the joystick 43 is tilted laterally and diagonally in the electric drive mode in which the motorized forward-rearward movement is possible, respectively, in preferred embodiments described above, the present invention is not restricted to this. In a preferred embodiment of the present invention, the controller may alternatively perform a control to move the hull laterally and diagonally by driving both the main propulsion device and the auxiliary propulsion device when an operator other than the joystick is operated to move the hull laterally and diagonally in the electric drive mode in which the motorized forward-rearward movement is possible, respectively.

While the controller 50 preferably performs a control to shift to the electric drive mode when the joystick 43 is in the neutral state in the joystick mode in which driving of the main propulsion device 20 and the auxiliary propulsion device 30 is controlled based on an operation on the joystick 43, or when the non-joystick mode is on in which driving of the main propulsion device 20 and the auxiliary propulsion device 30 is controlled based on an operation on the operator 40 other than the joystick 43 in preferred embodiments described above, the present invention is not restricted to this. In a preferred embodiment of the present invention, the controller may alternatively perform a control to shift to the electric drive mode when the joystick is not in the neutral state in the joystick mode or when the joystick mode is not on.

While the controller 50 preferably performs the rudder angle change control when the joystick 43 is tilted in the forward-rearward direction in the electric drive mode in which the motorized forward-rearward movement is possible in preferred embodiments described above, the present invention is not restricted to this. In a preferred embodiment of the present invention, the controller may alternatively perform the rudder angle change control when an operator other than the joystick is operated to move the hull along the forward-rearward direction in the electric drive mode in which the motorized forward-rearward movement is possible.

While the controller 50 preferably performs a control to perform the motorized forward-rearward movement while the rudder angle A1 of the main propulsion device 20 is maintained in the forward-rearward direction of the hull 10 in preferred embodiments described above, the present invention is not restricted to this. In a preferred embodiment of the present invention, the controller may alternatively perform a control to perform the motorized forward-rearward movement while the rudder angle of the main propulsion device is turned with respect to the forward-rearward direction of the hull.

While the controller 50 preferably performs the calibration control to adjust the predetermined angle $\alpha$ according to the hull 10 in preferred embodiments described above, the present invention is not restricted to this. In a preferred embodiment of the present invention, the controller may not perform the calibration control to adjust the predetermined angle according to the hull. In such a case, the rudder angle of the auxiliary propulsion device may be manually set by the vessel operator when the auxiliary propulsion device is driven to move the hull along the forward-rearward direction, for example.

While only one main propulsion device 20 is preferably attached to the stern 11 of the hull 10 in preferred embodiments described above, the present invention is not restricted to this. In a preferred embodiment of the present invention, two or more main propulsion devices may alternatively be attached to the stern of the hull.

While only one auxiliary propulsion device 30 is preferably attached to the stern 11 of the hull 10 in preferred embodiments described above, the present invention is not restricted to this. In a preferred embodiment of the present invention, two or more auxiliary propulsion devices may alternatively be attached to the stern of the hull.

While the main propulsion device 20 is preferably steerable by about 30 degrees to each of the L side (the left side of the hull) and the R side (the right side of the hull) in preferred embodiments described above, the present invention is not restricted to this. In a preferred embodiment of the present invention, the main propulsion device may alternatively be steerable by an angle other than about 30 degrees to each of the left side and the right side of the hull.

While the auxiliary propulsion device 30 is preferably steerable by about 70 degrees to each of the L side (the left side of the hull) and the R side (the right side of the hull) in preferred embodiments described above, the present invention is not restricted to this. In a preferred embodiment of the present invention, the auxiliary propulsion device may alternatively be steerable by an angle other than about 70 degrees to each of the left side and the right side of the hull.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion system comprising:

a main propulsion device to be attached to a stern of a hull, including an engine to drive a main thruster to generate a thrust, and operable to rotate in a right-left direction to change a direction of the thrust;

an auxiliary propulsion device to be attached to the stern, including an electric motor to drive an auxiliary thruster to generate a thrust, operable to rotate in the right-left direction to change a direction of the thrust, and having a maximum output smaller than a maximum output of the main propulsion device;

an operator; and a controller configured or programmed to control driving of the main propulsion device and the auxiliary propulsion device based on a predetermined operation on the operator; wherein the auxiliary propulsion device is provided to one side of the hull in the right-left direction;

the controller is configured or programmed to perform a rudder angle change control to change a rudder angle of the auxiliary propulsion device by a predetermined angle to one side in the right-left direction of the hull with respect to a forward-rearward direction of the hull so as to move the hull along the forward-rearward direction without rotating the hull when motorized forward-rearward movement is performed to move the hull along the forward-rearward direction by driving the auxiliary propulsion device without generating the thrust from the main propulsion device; and the controller is configured or programmed to perform a control to perform the motorized forward-rearward movement while a rudder angle of the main propulsion device is maintained in the forward-rearward direction of the hull.

2. The marine propulsion system according to claim 1, wherein the controller is configured or programmed to perform a calibration control to adjust the predetermined angle according to at least one of a shape of the hull, a size of the hull, and attachment positions of the main propulsion device and the auxiliary propulsion device to the hull.

3. The marine propulsion system according to claim 1, wherein the operator includes a joystick; and the controller is configured or programmed to perform the rudder angle change control when the joystick is tilted in the forward-rearward direction in an electric drive mode in which the motorized forward-rearward movement is possible.

4. The marine propulsion system according to claim 3, wherein the controller is configured or programmed to perform a control to shift to the electric drive mode when the joystick is in a neutral state in a joystick mode in which the driving of the main propulsion device and the auxiliary propulsion device is controlled based on an operation on the joystick, or when a non-joystick mode is on in which the driving of the main propulsion device and the auxiliary propulsion device is controlled based on an operation on an operator other than the joystick.

5. The marine propulsion system according to claim 1, further comprising:

a battery to supply power to the electric motor of the auxiliary propulsion device; wherein the controller is configured or programmed to not perform a control to shift to an electric drive mode in which the motorized forward-rearward movement is possible when a remaining amount of the battery is smaller than a predetermined threshold.

6. The marine propulsion system according to claim 1, wherein the operator includes a joystick; and the controller is configured or programmed to perform a control to move the hull laterally and diagonally by driving both the main propulsion device and the auxiliary propulsion device when the joystick is tilted laterally and diagonally in an electric drive mode in which the motorized forward-rearward movement is possible, respectively.

7. The marine propulsion system according to claim 6, wherein the controller is configured or programmed to not perform a control to move the hull laterally and diagonally even when the joystick is tilted laterally and diagonally when the engine is stopped in the electric drive mode.

8. The marine propulsion system according to claim 7, wherein the controller is configured or programmed to perform a control to notify a vessel operator that the engine is stopped when the engine is stopped in the electric drive mode.

9. The marine propulsion system according to claim 1, wherein the operator includes a joystick; and the controller is configured or programmed to perform a control to rotate the hull by driving the auxiliary propulsion device without generating the thrust from the main propulsion device when the joystick is rotated in an electric drive mode in which the motorized forward-rearward movement is possible.

10. The marine propulsion system according to claim 1, wherein the main propulsion device is an engine outboard motor including the engine to drive a main propeller corresponding to the main thruster and provided on a centerline of the hull in the right-left direction; and the auxiliary propulsion device is an electric outboard motor including the electric motor to drive an auxiliary propeller corresponding to the auxiliary thruster and provided to one side of the centerline of the hull in the right-left direction.

11. A marine vessel comprising:

a hull; and a marine propulsion system provided on or in the hull; wherein the marine propulsion system includes:

a main propulsion device attached to a stern of the hull, including an engine to drive a main thruster to generate a thrust, and operable to rotate in a right-left direction to change a direction of the thrust;

an auxiliary propulsion device attached to the stern, including an electric motor to drive an auxiliary thruster to generate a thrust, operable to rotate in the right-left direction to change a direction of the thrust, and having a maximum output smaller than a maximum output of the main propulsion device;

an operator; and a controller configured or programmed to control driving of the main propulsion device and the auxiliary propulsion device based on a predetermined operation on the operator; wherein the auxiliary propulsion device is provided to one side of the hull in the right-left direction;

the controller is configured or programmed to perform a rudder angle change control to change a rudder angle of the auxiliary propulsion device by a predetermined angle to one side in the right-left direction of the hull with respect to a forward-rearward direction of the hull so as to move the hull along the forward-rearward direction without rotating the hull when motorized forward-rearward movement is performed to move the hull along the forward-rearward direction by driving the auxiliary propulsion device without generating the thrust from the main propulsion device; and the controller is configured or programmed to perform a control to perform the motorized forward-rearward movement while a rudder angle of the main propulsion device is maintained in the forward-rearward direction of the hull.

12. The marine vessel according to claim 11, wherein the controller is configured or programmed to perform a calibration control to adjust the predetermined angle according to at least one of a shape of the hull, a size of the hull, and attachment positions of the main propulsion device and the auxiliary propulsion device to the hull.

13. The marine vessel according to claim 11, wherein the operator includes a joystick; and the controller is configured or programmed to perform the rudder angle change control when the joystick is tilted in the forward-rearward direction in an electric drive mode in which the motorized forward-rearward movement is possible.

14. The marine vessel according to claim 13, wherein the controller is configured or programmed to perform a control to shift to the electric drive mode when the joystick is in a neutral state in a joystick mode in which the driving of the main propulsion device and the auxiliary propulsion device is controlled based on an operation on the joystick, or when a non-joystick mode is on in which the driving of the main propulsion device and the auxiliary propulsion device is controlled based on an operation on an operator other than the joystick.

15. The marine vessel according to claim 11, further comprising:

a battery to supply power to the electric motor of the auxiliary propulsion device; wherein the controller is configured or programmed to not perform a control to shift to an electric drive mode in which the motorized forward-rearward movement is possible when a remaining amount of the battery is smaller than a predetermined threshold.

16. The marine vessel according to claim 11, wherein the operator includes a joystick; and the controller is configured or programmed to perform a control to move the hull laterally and diagonally by driving both the main propulsion device and the auxiliary propulsion device when the joystick is tilted laterally and diagonally in an electric drive mode in which the motorized forward-rearward movement is possible, respectively.

17. The marine vessel according to claim 16, wherein the controller is configured or programmed to not perform a control to move the hull laterally and diagonally even when the joystick is tilted laterally and diagonally when the engine is stopped in the electric drive mode.

18. The marine vessel according to claim 17, wherein the controller is configured or programmed to perform a control to notify a vessel operator that the engine is stopped when the engine is stopped in the electric drive mode.

* * * * *